US009138627B1

(12) United States Patent
Layton

(10) Patent No.: US 9,138,627 B1
(45) Date of Patent: Sep. 22, 2015

(54) BUNT TRAINING BAT

(71) Applicant: Greg Layton, Lake George, NY (US)

(72) Inventor: Greg Layton, Lake George, NY (US)

( * ) Notice: Subject to any disclaimer, the term of this patent is extended or adjusted under 35 U.S.C. 154(b) by 78 days.

(21) Appl. No.: 13/793,295

(22) Filed: Mar. 11, 2013

Related U.S. Application Data

(60) Provisional application No. 61/605,293, filed on Mar. 19, 2012.

(51) Int. Cl.
*A63B 69/00* (2006.01)
*A63B 15/00* (2006.01)

(52) U.S. Cl.
CPC ..... *A63B 69/0002* (2013.01); *A63B 15/00* (2013.01); *A63B 2069/0008* (2013.01)

(58) Field of Classification Search
CPC .. A63B 15/005; A63B 69/0002; A63B 15/00; A63B 69/3632
USPC ..... 473/422, 44, 241, 453, 457
See application file for complete search history.

(56) References Cited

U.S. PATENT DOCUMENTS

| | | | | | |
|---|---|---|---|---|---|
| 2,780,098 | A | * | 2/1957 | Maroth | 473/233 |
| 3,270,564 | A | * | 9/1966 | Evans | 473/223 |
| 3,353,824 | A | * | 11/1967 | Hamson, Jr. | 473/458 |
| 4,179,125 | A | * | 12/1979 | Cone et al. | 473/241 |
| 4,214,751 | A | | 7/1980 | Simpson | |
| 4,575,090 | A | * | 3/1986 | Heseltine | 473/240 |
| 4,700,489 | A | * | 10/1987 | Vasile | 33/342 |
| 4,759,219 | A | * | 7/1988 | Cobb et al. | 473/457 |
| 4,871,168 | A | * | 10/1989 | Autorino et al. | 473/453 |
| D306,335 | S | * | 2/1990 | Franey | D21/759 |
| 5,056,783 | A | * | 10/1991 | Matcovich et al. | 473/453 |
| 5,259,620 | A | * | 11/1993 | Marocco | 473/224 |
| D351,868 | S | | 10/1994 | Pendergast | |
| 5,372,365 | A | * | 12/1994 | McTeigue et al. | 473/409 |
| 5,385,349 | A | * | 1/1995 | Marshall | 473/409 |
| 5,431,391 | A | * | 7/1995 | Tracey | 473/257 |
| 5,492,322 | A | * | 2/1996 | Smith | 473/404 |
| 5,492,329 | A | * | 2/1996 | Kronin | 473/220 |
| 5,590,875 | A | * | 1/1997 | Young | 473/457 |
| 5,632,484 | A | * | 5/1997 | Lambert | 473/241 |
| 5,755,623 | A | * | 5/1998 | Mizenko | 473/241 |
| 5,935,015 | A | * | 8/1999 | Spiegel | 473/226 |
| 6,165,083 | A | * | 12/2000 | Stenger et al. | 473/404 |
| 6,173,610 | B1 | * | 1/2001 | Pace | 473/233 |
| 6,209,371 | B1 | * | 4/2001 | Guinn | 72/31.05 |
| 6,468,166 | B1 | * | 10/2002 | Spitzer | 473/241 |
| 6,569,042 | B2 | * | 5/2003 | LaChance et al. | 473/457 |
| 6,607,450 | B1 | * | 8/2003 | Hackman | 473/223 |
| 6,640,200 | B1 | * | 10/2003 | Baum | 473/219 |
| 6,716,109 | B1 | * | 4/2004 | Murtha | 473/241 |
| 6,805,005 | B1 | * | 10/2004 | Elizondo | 473/219 |
| 6,830,520 | B1 | * | 12/2004 | Bollar | 473/457 |
| 6,839,973 | B1 | * | 1/2005 | Woodward | 33/371 |
| 6,923,737 | B1 | * | 8/2005 | Walker | 473/457 |
| D509,866 | S | * | 9/2005 | Kwon | D21/736 |

(Continued)

*Primary Examiner* — Mitra Aryanpour
(74) *Attorney, Agent, or Firm* — Mathew M. Hulihan, Esq.; Heslin Rothenberg Farley & Mesiti P.C.

(57) ABSTRACT

A bat useable for training bunting in baseball or softball includes a leveling device located within the barrel of the bat indicative of the angle between the axis of the bat and horizontal. A batter may use the bat and view the leveling device to determine whether the bat is held at a proper angle for bunting a baseball or softball. The leveling device may indicate the bat being held at different angles such as 0 degrees, 15 degrees, and 45 degrees from horizontal.

16 Claims, 6 Drawing Sheets

(56) References Cited

U.S. PATENT DOCUMENTS

| | | | | |
|---|---|---|---|---|
| 7,063,625 | B2 * | 6/2006 | Murtha | 473/251 |
| D543,251 | S | 5/2007 | Kelliher | |
| 7,621,859 | B2 * | 11/2009 | Kim | 473/219 |
| 7,727,090 | B2 * | 6/2010 | Gant | 473/453 |
| 7,775,899 | B1 * | 8/2010 | Cannon | 473/226 |
| 8,622,854 | B2 * | 1/2014 | Suzuki | 473/453 |
| 2003/0134698 | A1 | 7/2003 | Clark et al. | |
| 2004/0259651 | A1 * | 12/2004 | Storek | 473/131 |
| 2007/0225091 | A1 | 9/2007 | Thomas | |
| 2008/0039241 | A1 | 2/2008 | Pope | |
| 2010/0041500 | A1 * | 2/2010 | Whitney et al. | 473/457 |
| 2011/0250994 | A1 | 10/2011 | Budzielek | |

* cited by examiner

BUNT TRAINING BAT

CLAIM OF PRIORITY

This application claims priority to U.S. Provisional Application No. 61/605,293 filed Mar. 19, 2012 and titled "Bunt Training Bat", which is incorporated herein by reference in its entirety.

BACKGROUND OF THE INVENTION

This application relates to baseball and softball bats and particularly to a bunt training bat.

Bunting is an important aspect of the games of baseball and softball. Significant improvement in quality of play and game enjoyment can result from developing and improving upon proper bunting technique, of which there are multiple kinds.

Bunting is a maneuver made with a bat by a batter in response to a ball thrown by a pitcher. The purpose of the maneuver is to contact the ball with the bat so as to push the ball downwards and into the field of play, thereby orienting and minimizing the movement of the ball such that it does not approach a fielder. By bunting a ball, a batter attempts to prolong the time it takes for his opponents to field the ball so that he may reach first base without being put out or another base runner may advance a base while the ball is fielded in an attempt to put the batter out.

There are four basic steps to the process of bunting. First, the batter "squares around" by turning so that his toes, knees, shoulders, and head are facing the pitcher. Second, the batter bends his knees slightly. Third, the batter holds the bat in front of him, approximately at the level of his eyes. To bunt right-handed, the left hand is placed on the handle of the bat, towards the batter's left, while the right hand is placed near the narrow part of the barrel of the bat, towards the batter's right, and vice versa. Depending on the bunting technique being used, the angle at which the bat is held may be approximately horizontal to the ground, or may be increased to approximately 45 degrees above horizontal by raising the barrel. Fourth, when the pitcher releases the ball, the batter adjusts placement of the bat by extending or flexing his legs to raise the bat up or down, respectively, so that the bat contacts the ball.

Variability in the execution of either of two acts can introduce variability in and impair bunting performance: the distance between handle and the hand that is placed near the narrow part of the barrel, and the angle at which the bat is held relative to horizontal. The invention disclosed, herein is for a bat that is modified in ways that enable improvement in practicing, executing, and teaching proper bunting techniques by providing objective feedback on whether a batter's positioning of a bat and his hands upon it are appropriate for a desired bunting technique. The invention disclosed herein also presents a means of providing visual feedback as to each of these acts during the execution of a bunt so that a batter may adjust his technique and improve performance and learn to consistently replicate proper technique.

SUMMARY OF THE INVENTION

In one aspect, the invention includes a bat for use in bunting a baseball or softball. The bat has a barrel thereof and at least one leveling device within the barrel. The leveling device is configured to indicate information relating to an angle between the axis of the bat and horizontal. The leveling device is observable by a batter during batting.

The leveling device may be an inclinometer and the inclinometer may comprise a vial of fluid. The inclinometer may contain markings thereon indicative of angle magnitudes. And, the inclinometer may include colorations which contrast with one another to indicate the angle of the bat. The bat may also include a plurality of inclinometers oriented at different angle positions relative to the axis of the bat. The leveling device may indicate the bat being held at a predetermined angle by a batter. The barrel of the bat may have the leveling device therein and be made of clear material so that the leveling device within the barrel can be viewed through the barrel. The leveling device may be removable and replaceable from the barrel of the bat. The bat may also include a marking located at a position indicative of where a hand should be placed on the bat so as to properly execute a bunt. This marking may be located near the handle of the bat. The bat may also include a grip material on the handle.

In one aspect, the invention includes a method of bunting useable for training bunting. The method involves gripping a bat having a barrel with at least one leveling device therein, viewing the leveling device to determine information regarding the angle of the bat, and bunting a ball using the bat. The method may also include adjusting the angle of the bat based upon viewing the leveling device to bunt the ball. The leveling device may be an inclinometer including a vial of fluid. Multiple inclinometers may be used within the barrel of the bat; each inclinometer indicative of a particular angle of the bat during bunting.

One aspect of the present invention is a bat whereupon a marking is made where the hand that is placed near the narrow part of the barrel should be placed. When bunting with such a bat, a batter can compare the locations of such marking and his hand and move his hand accordingly if necessary. Or, an observer can instruct the batter to correctly position his hand in relation to the marking.

Another aspect of the present invention is the inclusion of an inclinometer or other leveling device inside or attached to the outside of the bat so that, while bunting, the batter or an observer may look at the bat to see an objective indication of the angle at which the bat is being held relative to horizontal. The batter may then adjust his or her angle thereafter, including upon subsequent bunting attempts. For example, the bat could be made of a clear plastic such as acrylontirile butadiene styrene (ABS). Within such a bat and visible to the batter or observer is an inclinometer oriented so that the batter or observer can look at the inclinometer to determine whether the barrel of the bat should be raised or lowered to attain the desired bat angle.

Additional features and advantages are realized through aspects of the present invention. Other embodiments and aspects of the invention are described herein and are considered a part of the claimed invention.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Figure 1:
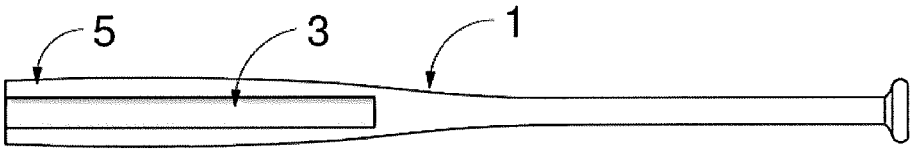
FIG. 1 depicts cross sectional view of a portion of a bunt training bat useable for the present invention.

Referring to FIG. 1, a cross section of a portion of a bat 1 according to one aspect of the invention is shown. The bat 1 includes a hollow bore portion 3 in the barrel 5 of the bat where an inclinometer would be inserted. The hollow bore portion 3 is sized and shaped so that an inclinometer would securely fit therein. For example, an arcuate-shaped hollow bore would be made to accommodate an arcuate-shaped inclinometer. The bat 1 is symmetrical in shape about its central axis, similar to a conventional baseball bat. The bat 1 is preferably made of clear polycarbonate, or another type of clear material capable of withstanding the impact of a baseball or softball. The bat is preferably formed so that the clear polycarbonate material also forms the inner surface of the hollow bore portion 3 of the bat 1. Use of such clear polycarbonate, or other clear type of material, allows the inclinometer to be inserted in hollow bore portion 3 to be viewed through the outer surface or wall of the bat. In this manner, the inside of the bat 1 between the outer surface and the bore portions may also be hollow.

Figure 2:
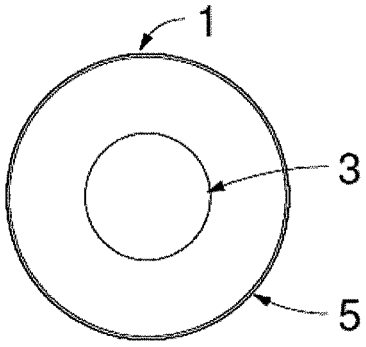
FIG. 2 depicts an end view of the bat of FIG. 1 showing the opening of a bore at the top of the barrel of the bat.

Referring to FIG. 2, an end view of the barrel 5 of the bat 1 of FIG. 1, along the central axis of the bat from the barrel end is shown. In the middle of the barrel of the bat is the hollow portion 3 in which an inclinometer (not shown in FIG. 1 or 2) would be contained.

Figure 3:
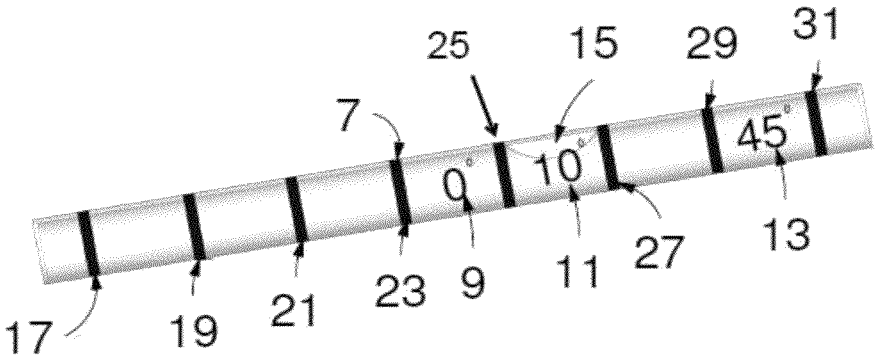
FIG. 3 depicts a front view of an inclinometer and leveling device useable in the bat depicted in FIG. 1 and FIG. 2.

Referring to FIG. 3, a side view of an inclinometer 7 insertable within the hollow portion shown in FIG. 2, is shown. The inclinometer 7 is a vial type inclinometer filled with fluid including a bubble 15 therein. The bubble 15 moves within the fluid and vial as the angle of the vial changes. The vial type inclinometer includes marks, such as shaded marks 9, 11, 13, which relate or correspond to a particular angle. The inclinometer includes a plurality of lines representing a location where, if the bubble 15 is located, the bat is being held at a particular angle. As shown in FIG. 3, the bubble 15 in the vial is located in a position designated by marking 11 and indicating the vial (or bat within which the vial is located) is at an angle of 10% from horizontal. Other markings 9 and 13 show readings the inclinometer would give if the bat were held horizontal (zero degrees) or 45 degrees above horizontal, respectively. The vial inclinometer 7 also includes lines thereon 17, 19, 21, 23, 25, 27, 29, 31 which define the borders of locations in the inclinometer where if, the bubble is located, the particular angle is achieved.

Figure 4:
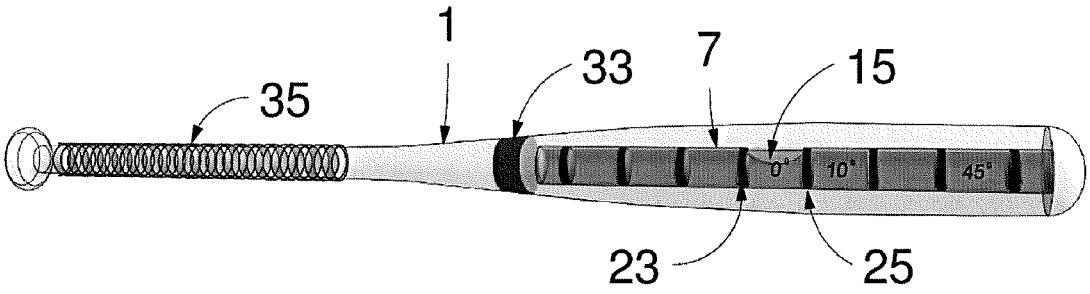
FIG. 4 depicts a side view of the bat of FIG. 1 and FIG. 2 having the inclinometer inserted into the bore at the head thereof and cap on the end of the bat head.

FIG. 4 shows the bat 1 depicted in FIGS. 1 and 2, with the vial type inclinometer 7 of FIG. 3 inserted therein and an end cap mounted on the end of the bat head. The bat includes a mark or other indicia 33 for placement of the batter's hand near the narrow part of the barrel. The shading within the inclinometer 7 indicates that the bat is being held level, i.e., at 0°, to the ground. Other markings on the inclinometer indicate readings the inclinometer 7 would give if the bat were held 10 or 45 degrees above horizontal. Also shown is a handle with bat grip material 35 to give the feel of a traditional bat.

Referring still to FIG. 4, the bat in accordance with one aspect of the present invention includes a single inclinometer 7 therein. The inclinometer 7 is a bubble type inclinometer comprising a fluid filled vial. The fluid filled vial includes a bubble 15 which changes position depending upon the angle of the bat. As shown in FIG. 4, when the bat is held at level, i.e., 0° horizontal, the bubble 15 will be located at a position within the vial indicated at 0° and defined by the mark or shadings "0°" located between lines 23 and 25. Other areas of the vial will indicate different angles of orientation of the bat when the bubble is located in the corresponding area. For example, when the bubble is located within the area marked as "10°", located between adjacent shaded marked areas, the bat is held at 10 degrees for bunting purposes. Similarly, when the bubble is located in the shaded area depicted by "45°" and defined by adjacent lines or other markings, that will be held at 45 degrees from horizontal. Although the inclinometer of FIG. 4 shows preselected angle locations of 0, 10 and 45 degrees, other angles may be depicted or displayed by an inclinometer consistent with the principles of the present invention. For example, the inclinometer may indicate areas showing when the bat is held at 0, 15 or 45 degrees. The bat also includes a conventional grip 35 located at the handle end of the bat. Also, a mark 33 located at the transition area of the bat between the handle and barrel may be located to indicate where a batter should place his or her hand and/or fingers to execute a bunt.

Figure 5:
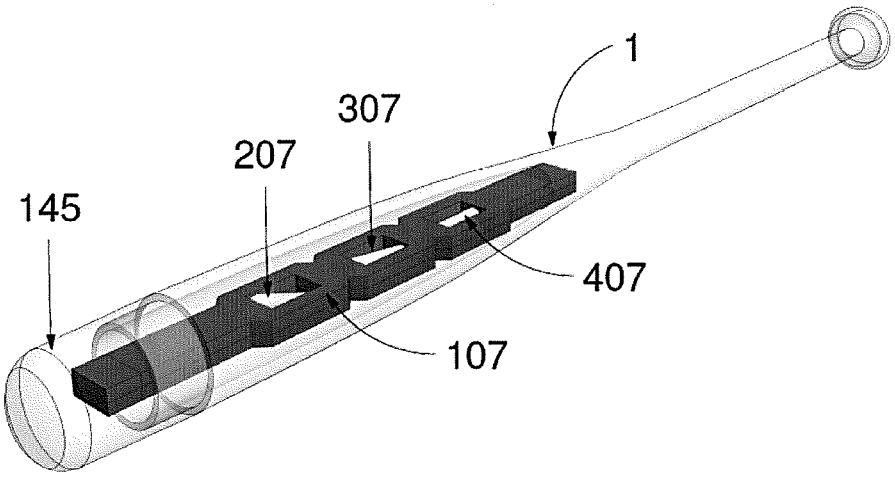
FIG. 5 depicts an isometric view of an alternative embodiment of a bunt training bat in accordance with the principles of the present invention shown in an isometric view thereof with an end cap.

Referring now to FIG. 5, another embodiment of a bat 100 useable in accordance with the principles of the present invention is shown. This embodiment is made of clear polycarbonate capable of withstanding the impact of a baseball or softball. Similarly, other clear materials may also be used for the bat. The bat 1 includes a leveling device 107 inserted within the barrel thereof. In this embodiment, the leveling device includes three individual inclinometers 207, 307, 407.

Figure 6:
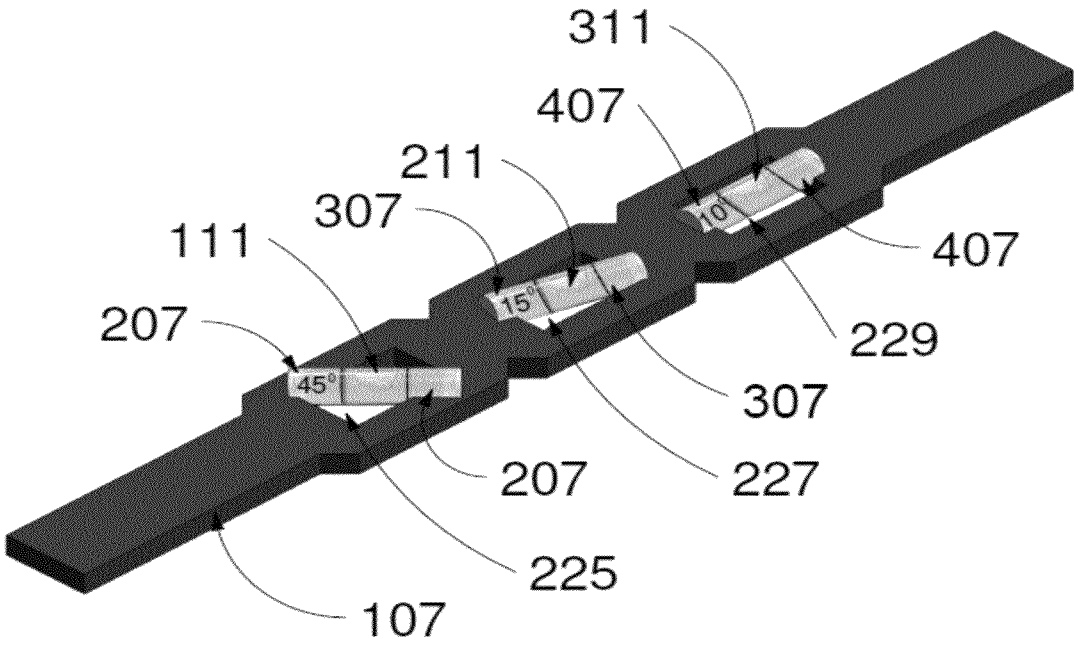
FIG. 6 depicts an isometric view of a bracket insertable within the barrel of the bat depicted in FIG. 5.

FIG. 6 depicts the leveling device in the bat of FIG. 5. As shown in FIG. 6, each inclinometer is formed of a fluid filled vial with a bubble 111, 211, 311 therein. Each vial, for example, is marked with a particular angle and adjacent markings. When the bubble is located between the adjacent markings, the bat is oriented at the angle depicted therein. For example, the first vial inclinometer 407 includes a marking of "0°" such that when the bat is held at 0 degrees relative to horizontal, a bubble 311 is located in the 0 degree area as defined by adjacent markings. Similarly, a second inclinometer 307 vial contains markings "15°" indicating when the bat is oriented at 15 degrees, for example. The second vial inclinometer contains an adjacent line whereby when the bat is oriented at 15 degrees from horizontal, the bubble 211 within the vial is located between these adjacent lines. The third vial inclinometer 207 is oriented and marked "45°" to depict when the bat is held at 45 degrees from horizontal. The third vial inclinometer 207 also includes markings in the form of adjacent lines located such that the bubble 111 within the vial when positioned between the adjacent lines occurs when the bat is held at 45 degrees from horizontal.

Referring still to FIG. 6, the leveling device 107 is formed as a bracket used to hold the first, second and third inclinometer vials 407, 307, 207, respectively, shown. The bracket is configured and/or sized to securely fit into a hollow section 303 of the bat shown in FIG. 5 and FIG. 7. Each inclinometer vial fits into a respective recess 225, 227, 229 within the bracket oriented at a particular angle relative to the lengthwise axis of the bracket. For example, the first inclinometer vial is located in a recess formed parallel with the axis of the bracket. The second inclinometer is formed into a recess which is oriented at an angle of 15 degrees from the axis of the bracket, while the third vial inclinometer is formed into a recess oriented at an angle of 45 degrees from the lengthwise axis of the bracket.

Figure 7:
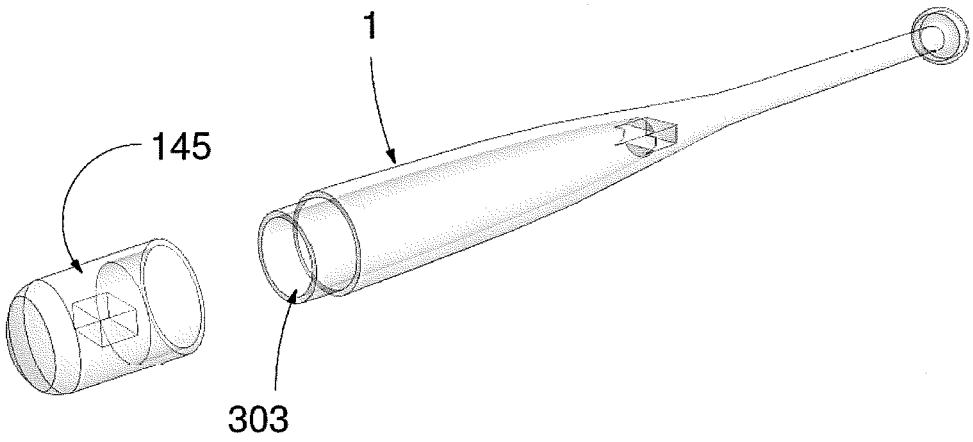
FIG. 7 depicts an isometric view of the bracket of FIG. 5 having multiple inclinometers or leveling devices therein.

Referring now to FIG. 7, the bat 1 may include a removable endcap 145. The endcap fits on the barrel and the bat (as shown in FIG. 5). The hollow section of the bat 303 is configured to receive leveling device 107. Such that leveling device 107 is insertable into the hollow section 303 of the bat 1 to securely fit therein. For example, the ends of leveling device 107 may be formed as rectangular sections to fit into a complimentary rectangular section within the hollow portion 303 of the bat. Similarly, the opposite end of the leveling device may also be, for example, a rectangular section which fits into a rectangular section located in the hollow portion of the endcap 145. In this manner, when the leveling device is inserted into the bat 1 and hollow section 303 and the rectangular ends are fitted therein, the opposite rectangular end is fitted into the receiving section of endcap 145 and endcap 145 is placed onto the barrel of the bat and secured thereto. In multiple aspects of the invention including the bat depicted in FIGS. 1-4 and FIGS. 5-7. The endcap may be secured to the barrel of the bat by various means including having a shape of the endcap which interlocks with the shape of the barrel of the bat. For example, each section may be octagonal shaped and the endcap sized to fit over a similarly octagonal shaped end portion of the barrel of the bat.

The bat depicted in FIG. 4 may be used to train a batter to bunt in accordance with a particular bunting technique. For example, the batter may use the bat 1 to grip the bat on grip material 35 with one hand and on mark 33 with the other hand. That may be gripped this way when the batter is in a conventional bunting stance relative to home plate, e.g., when the batter "squares around". When gripping the bat according to this technique, the bat may be manipulated to be at a particular angle relative to horizontal. The batter is taught to bat the ball at an angle of 45° for the bat, the batter may view the inclinometer and hold the bat at a 45° angle by adjusting the angle of the bat until the bubble 15 within the inclinometer 7 is located at marking at the 45° marking on the bat between the adjacent lines in the inclinometer on either side of the 45° marking. Similarly, if the batter is taught to bunt the ball and hold the ball at an angle of 10°, the batter can manipulate the angle of the bat until the bubble 15 moves over the 10° marking between the lines on the bubble pounding the 10° marking. In accordance with this technique, a bunt training bat having different inclinometer markings thereon may be used and made to teach bunting holding a bat at various different angles. The angles may include 0°, 10°, 15°, 30° and 45°. Furthermore, any other degree or angle may be used in such a corresponding inclinometer.

Referring now to FIG. 5, the bat 1 depicted therein can also be used to train and teach bunting. In this particular technique, the bat contains three different inclinometers 207, 307, and 407. Inclinometer 207 includes markings corresponding to an angle of 45°, inclinometer 307 includes markings corresponding to an angle of 15°, and inclinometer 407 includes markings corresponding to an angle of 0°. The train or teach bunting at an angle of 45°, a batter would grip the bat 1 using a conventional bunting grip and stance as previously described herein. The batter would then hold the bat at an angle while viewing inclinometer 207. The inclinometer 207, which is a vial type inclinometer, will indicate the bat is being held at 45° when the bubble within the vial is properly lined with the markings thereon indicating that the bat is held at 45°. The batter may then attempt to bunt the ball with the bat at 45° to achieve the desired bunting technique at such an angle. Similar technique may be used to train bunting the ball at 15° by viewing vial 307 and bunting the ball when the markings when the bubble within vial 307 corresponds to the markings indicating the bat is being held at a 15° angle. And, of course, the similar technique may be used to train or teach bunting at a 0° angle, if desired, by viewing inclinometer 407 and holding the bat at a 0° angle and bunting the ball when the bubble in inclinometer 407 is located in a position corresponding to 0°.

Alternatively, a leveling device may be affixed to the outside of the outside of the bat. In such case, the leveling device could be affixed where it would not contact the ball being thrown by the pitcher, such as to the handle or the side of the barrel that does not face the pitcher, to prevent the leveling device from directly interfering with the movement of the ball that results from its contacting the bat as well as protect the leveling device from breakage resulting from directly contacting the ball. A leveling device affixed to the outside of the bat could also be designed so as to be removable. If an arcuate-shaped inclinometer 7 were used, during bunting the bat would be held so that the arc curved straight downwards towards the ground (if a bubble-type inclinometer were used) or straight upwards towards the sky (if a ball-type inclinometer were used).

The a bat may be made to meet any size, weight, or other required parameters mandated by the governing bodies of professional, amateur, college, or youth baseball or softball leagues or associations, aside from proscriptions against making a bat out of clear plastic or that is not completely solid, or attaching objects to the outside of the bat, or other means by which a leveling device is incorporated with a bat used in accordance with the present invention.

Contrasting coloration of the elements of the inclinometer can be used to optimize readability. For example, if a bubble-type inclinometer is used, the gas bubble could be given a color that increases its visibility relative to the colorless liquid that fills the rest of the inclinometer's chamber, the liquid could be colored such that the colorless bubble would be more easily seen, or the bubble and liquid could each be colored so as to contrast with each other. Similarly contrasting coloration schemes could be used if a ball-type inclinometer were used instead of a bubble-type inclinometer. The bat or inclinometer may be marked so as to provide quantification or description of the bat's angle when held at one or more predetermined positions. For example, markings may indicate when tilting the barrel of the bat a given amount above the handle results in the bat's angle being 10 or 45 degrees above horizontal, or at an angle above horizontal designated as "low" or "high." Additional markings consistent with this scheme could also be made to signify additional angles at which the bat is being held.

The handle of the bat could be made to more closely resemble the feel of a traditional bat, such as by the application of traditional bat gripping material to it. Or, the handle of the bat could be separable from the barrel, with the handle being made of a material of which bats are typically made, such as wood, the barrel being made of ABS plastic and containing an inclinometer, and the two could be secured together such as with a male-threaded post extending from the bottom of the barrel that fits securely into a female-threaded hole formed in the top of the handle. Or, the handle could be made of ABS plastic and contain the inclinometer and could be secured to a barrel made of wood.

The corresponding structures, materials, acts and equivalence of all means or steps plus function elements in the claims below, if any, are intended to include any structure, material or acts for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments depicted herein were chosen and described in order to best explain the principles of one or more aspects of the invention and the practical application, and to enable others of ordinary skill in the art to understand one or more aspects of the invention for various embodiments with various modifications as are suited to the particular use contemplated.

What is claimed is:

1. A bat for use in bunting a baseball or softball, the bat comprising:

a baseball or softball bat having a barrel thereof; and a leveling device within said barrel, said leveling device configured to indicate information relating to angles between an axis of the bat and horizontal, and said leveling device comprising a plurality of inclinometers, said plurality of inclinometers oriented at different angle positions relative to said axis of said bat.

2. The bat of claim 1 wherein an inclinometer of said plurality of inclinometers comprises a vial of fluid, wherein the inclinometer contains markings thereon indicative of angle magnitudes.

3. The bat of claim 1 wherein the leveling device is configured to indicate the bat being held at a predetermined angle.

4. The bat of claim 1 wherein the barrel having said leveling device therein is made of a clear material wherein said leveling device within said barrel can be viewed through said barrel.

5. The bat of claim 1 in which a plurality of operative elements of the plurality of inclinometers are of colorations that contrast with each other.

6. A method comprising:

obtaining a baseball or softball bat having a barrel thereof, said bat for use in bunting a baseball or softball; and disposing a leveling device at least partially within said barrel of said bat, wherein said leveling device indicates information relating to an angle between an axis of the bat and horizontal, wherein said leveling device comprises a plurality of inclinometers, said plurality of inclinometers oriented at different angle positions relative to said axis of said bat.

7. The bat of claim 3 wherein the leveling device is removable and replaceable from said barrel.

8. The bat of claim 1 further comprising a mark located at a position indicative of where a hand should be placed so as to properly execute a bunt, said mark being located near the handle of said bat.

9. The method of claim 6 wherein an inclinometer of said plurality of inclinometers comprises a vial of fluid.

10. The method of claim 9 wherein said inclinometer of said plurality of inclinometers contains markings thereon indicative of angle magnitudes.

11. The method of claim 10 wherein the barrel having said leveling device disposed at least partially therein is made of a clear material wherein said leveling device disposed at least partially within said barrel can be viewed through said barrel.

12. The method of claim 6 wherein the leveling device is configured to indicate the bat being held at a predetermined angle.

13. The method of claim 6 wherein the leveling device is removable and replaceable from said barrel.

14. The method of claim 6, wherein the bat further comprises a mark located at a position indicative of where a hand should be placed so as to properly execute a bunt, said mark being located near a handle of said bat.

15. The method of claim 14 wherein the bat further comprises a grip material on the handle of said bat.

16. The method of claim 6 wherein a plurality of operative elements of the plurality of inclinometers are of colorations that contrast with each other.

* * * * *